US005903298A

United States Patent [19]

Takeuchi et al.

[11] Patent Number: 5,903,298

[45] Date of Patent: May 11, 1999

[54] LINE THERMAL PRINTER

[75] Inventors: Kiyokazu Takeuchi; Saburo Imai, both of Chiba, Japan

[73] Assignee: Seiko Instruments Inc., Japan

[21] Appl. No.: 08/776,491

[22] PCT Filed: Jun. 11, 1996

[86] PCT No.: PCT/JP96/01580

§ 371 Date: Jan. 24, 1997

§ 102(e) Date: Jan. 24, 1997

[87] PCT Pub. No.: WO96/41723

PCT Pub. Date: Dec. 27, 1996

[30] Foreign Application Priority Data

Jun. 13, 1995 [JP] Japan ..... 7-146567

[51] Int. Cl.[6] ..... B41J 25/304; B41J 29/02

[52] U.S. Cl. ..... 347/197; 347/222

[58] Field of Search ..... 347/222, 197, 347/198; 400/120.16, 120.17, 691, 692, 693

[56] References Cited

U.S. PATENT DOCUMENTS 5,198,836 3/1993 Saito et al. ..... 347/197

FOREIGN PATENT DOCUMENTS 0463595 1/1992 European Pat. Off. ..... 347/197
2706359 12/1994 France ..... 347/197
4-140176 5/1992 Japan ..... 347/197

*Primary Examiner*—Huan Tran
*Attorney, Agent, or Firm*—Adams & Wilks

[57] ABSTRACT

A line thermal printer comprises a frame, a platen supported by the frame for rotation, and a thermal head supported by the frame for pivotal movement into and out of pressure contact with the platen for recording printing data to a recording medium disposed between the thermal head and the platen. A leaf spring is disposed between the thermal head and the platen for resiliently pressing the thermal head into pressure contact with the platen. A pressing plate has a rotation shaft supported by the frame for pivotal movement for applying pressure to the leaf spring to resiliently press the thermal head into pressure contact with the platen. A head-up lever is integrally connected to an end of the rotation shaft of the pressing plate for pivoting the pressing plate to release the pressure applied to the leaf spring to release the thermal head from pressure contact with the platen.

28 Claims, 4 Drawing Sheets

LINE THERMAL PRINTER

TECHNICAL FIELD

The present invention relates to a structure of a small line printer and, more particularly, to a head-up structure of a thermal head for a small line thermal printer.

BACKGROUND ART

A prior art example of a general small printer using a line type thermal head will be explained based on a section view shown in FIG. 6.

In the figure, the prior art printer comprises a platen 5 provided for rotation with respect to a frame 1, a thermal head 6 pressed to the platen 5, a platen spring 19 for pressing the thermal head 6 resiliently to the platen 5, a platen spring receiving plate 20 for receiving resilience of the platen spring 19, a head-up lever 10 having a cam 10*a* for releasing the thermal head 6 from the platen 5 during maintenance for exchanging sheets of paper or a jammed paper, a head-up pin 8 provided on the thermal head 6 for engaging with the cam 10*a* to release the thermal head 6 from the platen 5, a thermal head pivot 17 which is a center axis of rotation of the thermal head 6, and other components.

In the small printer using the line thermal head, it is necessary to press and contact the thermal head to the platen with homogeneous pressure across the whole printing range from the aspect of printing quality and the like.

Accordingly, the prior art printer constructed as described above has been adapted such that one coil spring is disposed as the platen spring in a manner capable of freely rocking centering on a fulcrum so that its resilience acts homogeneously between the platen and the thermal head, or such that a plurality of coil springs each having homogeneous resilience are disposed at adequate points on the back of the thermal head to eliminate the unevenness of contact of the platen and the thermal head.

As a result, although the unevenness of contact of the platen and the thermal head has been improved, there has been a problem that the coil spring is repeatedly stretched and compressed every time when the head is opened and closed, thus causing a degradation of the spring such as settling as a result, because the thermal head has an opening/closing mechanism for maintenance with respect to the platen and the coil spring is designed so that it exerts an adequate resilience when the thermal head abuts with the platen. In case of the printer using the plurality of coil springs in particular, the resilience may vary per each coil spring, thus changing the pressing stress between the platen and the thermal head partially. Accordingly, there have been such problems with conventional line printers that the printing quality is degraded and failure of the printer itself may occur. There has been also another problem that because the repulsive resilience of the coil spring becomes large when it is compressed during head-up and the mechanical strength of the platen spring receiving plate for receiving such large resilience has to be increased, it has been difficult to design such printer from the aspect of its structure and strength.

Further, because the head-up operation carried out by means of the head-up lever has been carried out by abutting the head-up cam only to one side of the head-up pin and resisting to the resilience of the coil spring in general, there has been a problem that the other end of the thermal head which does not engage directly with the head-up cam has a large inclination and it becomes difficult to provide proper maintenance such as correcting a paper jam in a printer using a line thermal head having a wider width. There have been also other problems that the use of the coil spring which is cumbersome to assemble lowers the assembly efficiency of the printer and complicates the structure around the head of the printer, thus increasing the cost of the printer.

Accordingly, it is an object of the present invention to improve the printing quality further of a printer as well as to realize a printer having a more simplified structure and to improve the assembly efficiency thereof.

SUMMARY OF THE INVENTION

In view of the aforementioned problems, according to the printer of the present invention, a platen spring for pressing a thermal head is formed by one leaf spring having adequate length and width and the back of the whole leaf spring is pressed by a pressing plate having a width matched with that of the leaf spring to apply a homogeneous resilience to the whole thermal head.

Further, a head-up lever is fixed at one end of the pressing plate to head up the main body of the thermal head when the pressure of the thermal head applied by the pressing plate is released, thus realizing the printer having such simple structure.

According to the present invention, because the leaf spring is used as the platen spring, is disposed between the thermal head and the pressing plate and is pressed by the pressing plate to press the whole thermal head resiliently to the platen, the thermal head may be pressed into pressure contact with the platen homogeneously.

Further, the head-up lever is provided at one end of the pressing plate in a body with the pressing plate. When the engagement of the pressing plate with the leaf spring is released by turning the head-up lever, the leaf spring is placed in a free state and the resilience to the leaf spring is released, thus allowing the degradation and the like of the leaf spring to be reduced. Then, by turning the head-up lever further, the thermal head released from the pressure of the leaf spring may be released in the direction separated from the platen through a cam formed on the head-up lever without resisting to the resilience of the pressing plate.

As a result, because the thermal head is not released eccentrically during head-up and the platen spring can be formed simply by one leaf spring, the structure of the printer may be simplified and the assembling efficiency may be improved.

DETAILED DESCRIPTION OF THE PREFERRED EMBODIMENT

A preferred embodiment of the present invention will be explained below in detail with reference to the drawings.

Figure 1:
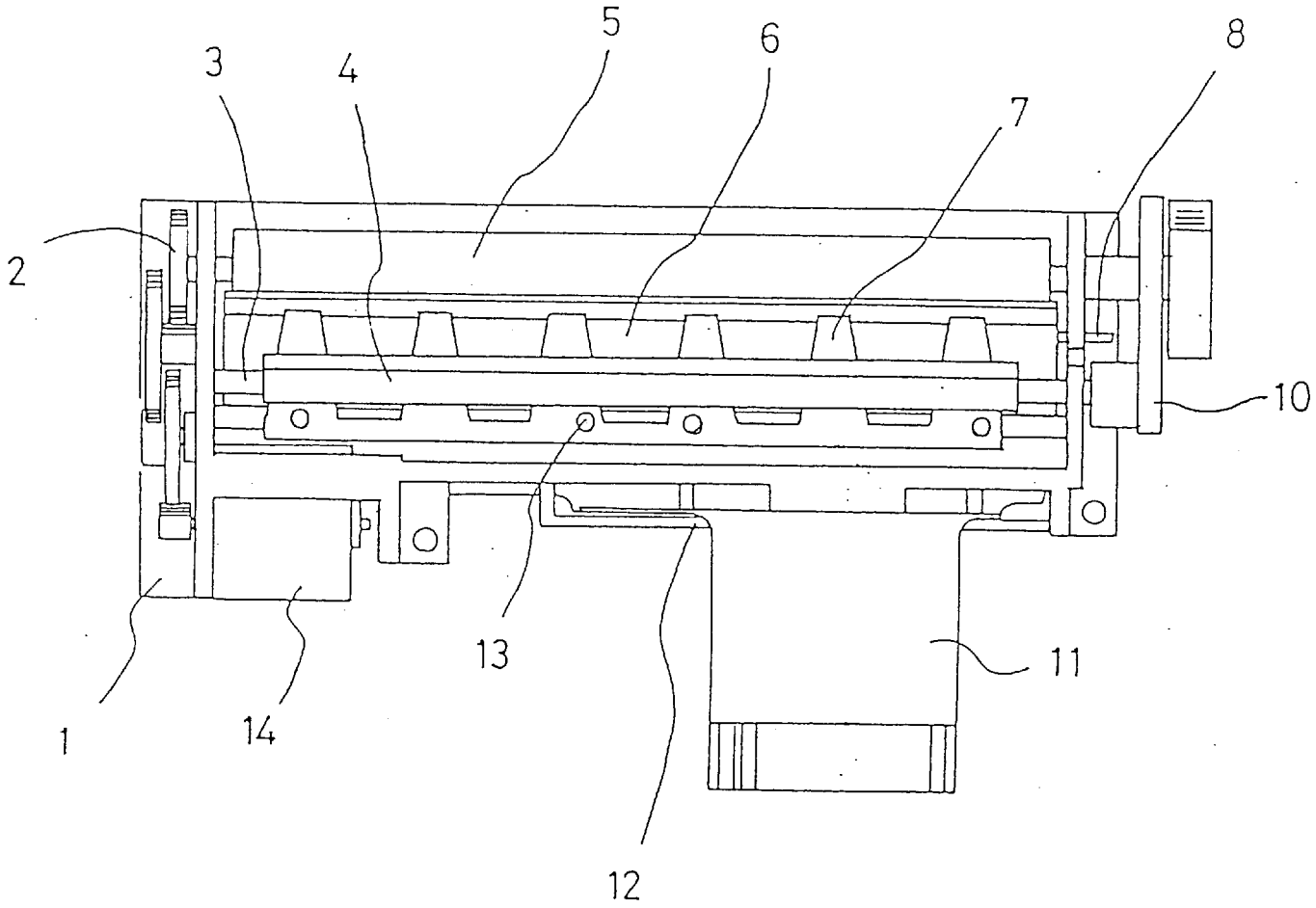
FIG. 1 is a plan view of a printer of the present invention.

FIG. 1 is a plan view showing one embodiment of an inventive printer which comprises, at least, a frame 1 which is the base of the printer, a platen 5 having a rotational center shaft 5*a* supported by the frame for rotational movement, a line type thermal head 6 which abuts resiliently with the platen 5 to record printing data on a recording sheet 15 disposed between it and the platen, a biasing member, such as a leaf spring 7, which corresponds to the prior art platen spring, a pressing plate 4 for resiliently pressing the thermal head 6 to the platen 5 via resilience of the leaf spring 7 by pressing the leaf spring 7, a motor 14, for turning the platen via a gear train 2, a flexible board 11 (hereinafter referred to as FPC) for transmitting driving signals to the thermal head 6, and other components.

The platen 5 is disposed such that both ends of the rotational center shaft 5*a* thereof are journalled at predetermined positions of the frame 1, and a gear composing the gear train 2 is secured at one end of the rotational center shaft so as to receive rotational power from the motor 14 and to be able to convey recording sheets pinched between it and the thermal head 6 adequately by the rotational power of the motor 14.

The thermal head 6 which is a line type thermal head is disposed near the platen 5 in parallel with the rotational shaft of the platen and a head-up pin 8 is provided at one end of the thermal head in the longitudinal direction thereof and integral therewith. Further, the thermal head 6 is provided with a rotational center shaft 17, (FIGS. 2–4) which becomes the center of rotation during head-up at the both ends in the width direction thereof and is supported by the frame via the rotational center shaft for pivotal movement.

The pressing plate 4 is disposed near the thermal head in parallel with it and its section is formed in a shape of cam. The pressing plate is provided with a rotational center shaft 3 at both ends thereof and is supported by the frame for pivotal movement. Further, a head-up lever 10 is provided at one end of the rotational center shaft 3 and a cam 10*a* (FIG. 4) is formed at a portion of the head-up lever 10. When the head-up lever 10 is turned, the cam 10*a* engages with the head-up pin 8 provided on the thermal head 6 depending on its turn position and releases the thermal head 6 from the platen 5. At the same time, the cam 10*a* contacts with a head-up switch 18 which turns ON or OFF an electrical signal indicating a head-up or head-down state in linkage with the head-up of the thermal head 6.

The leaf spring 7 is disposed between the thermal head 6 and the pressing plate 4 while being positioned by pins 13 positioned at adequate spots of the frame 1 and resiliently presses or biasses the thermal head 6 in the direction of the platen 5 by means of the pressing plate 4 formed in the shape of cam depending on the turn position of the pressing plate 4 which is turned by the head-up lever 10.

In the present embodiment, a portion at the edge of the leaf spring 7 which contacts with the thermal head 6 is formed in a shape of so-called angle in which a cutaway portion is created partly in order to apply a predetermined resilience to the thermal head and the leaf spring is placed in a relaxed state in which it exerts no biasing force.

Next, the operation of the present invention will be explained below.

FIGS. 2 through 5 are diagrammatic section views of the printer of the present embodiment.

Figure 2:
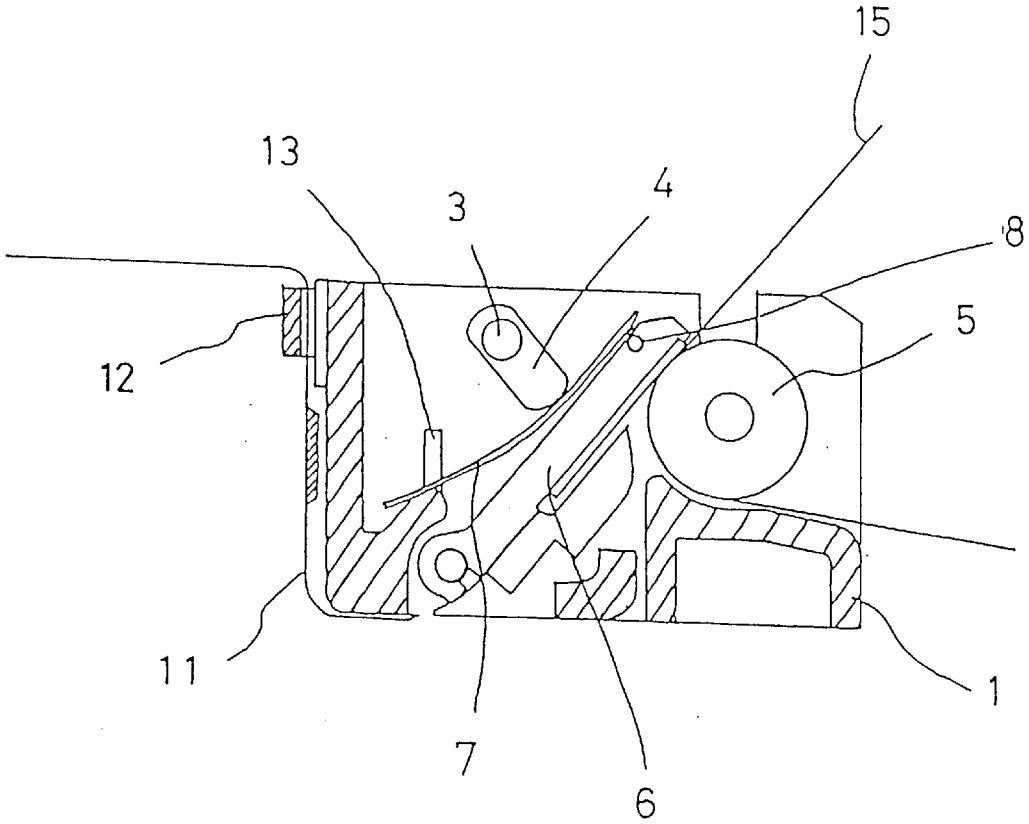
FIG. 2 is a section view showing a state in which a thermal head of the inventive printer is pressed.
Figure 3:
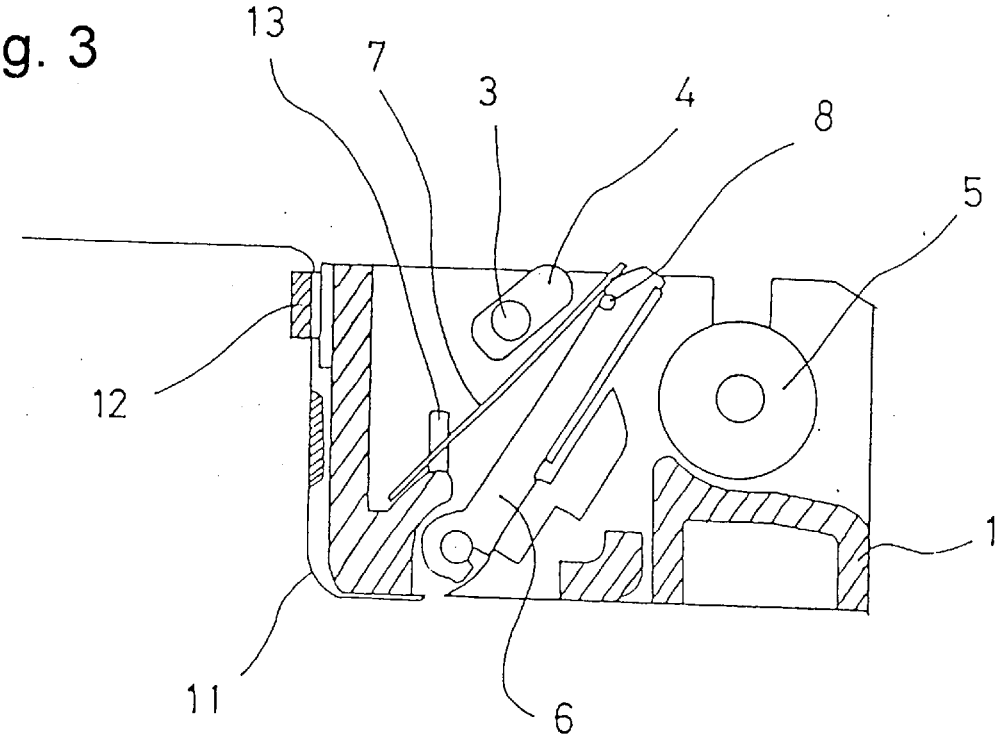
FIG. 3 is a section view showing a state in which the thermal head of the present invention is released.
Figure 4:
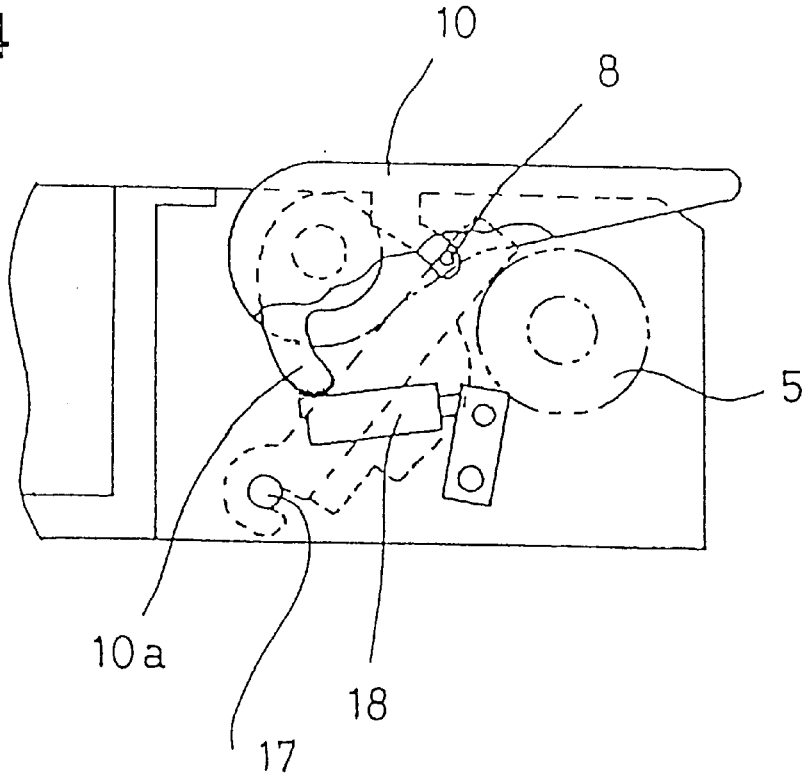
FIG. 4 is a section view of a head-up lever section in the state in which the thermal head of the present invention is pressed.
Figure 5:
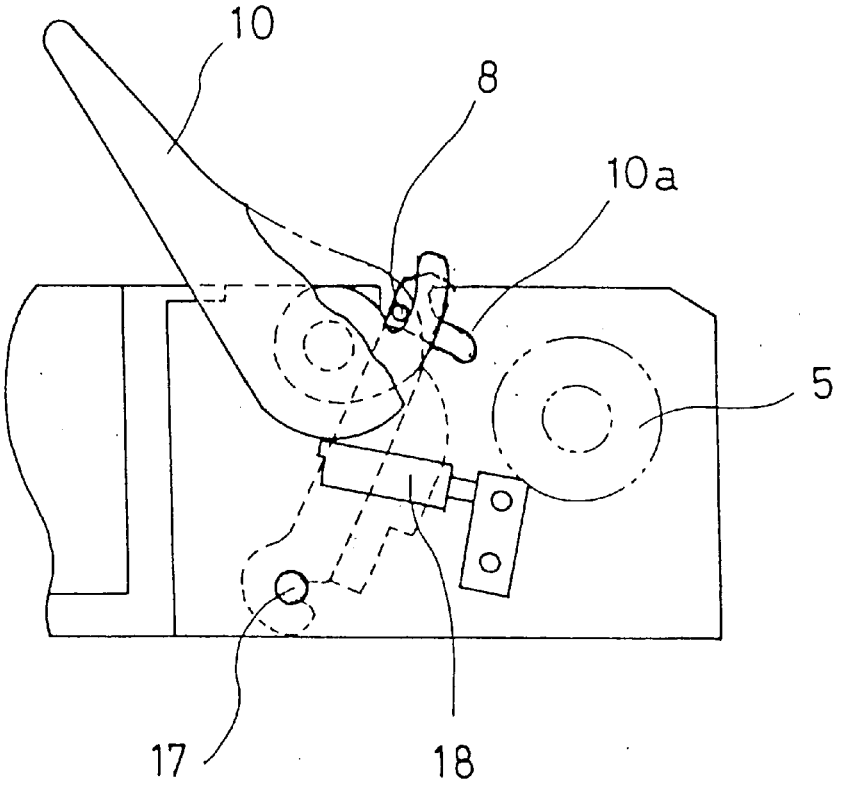
FIG. 5 is a section view of the head-up lever section in the state when the thermal head of the inventive printer is released.
Figure 6:
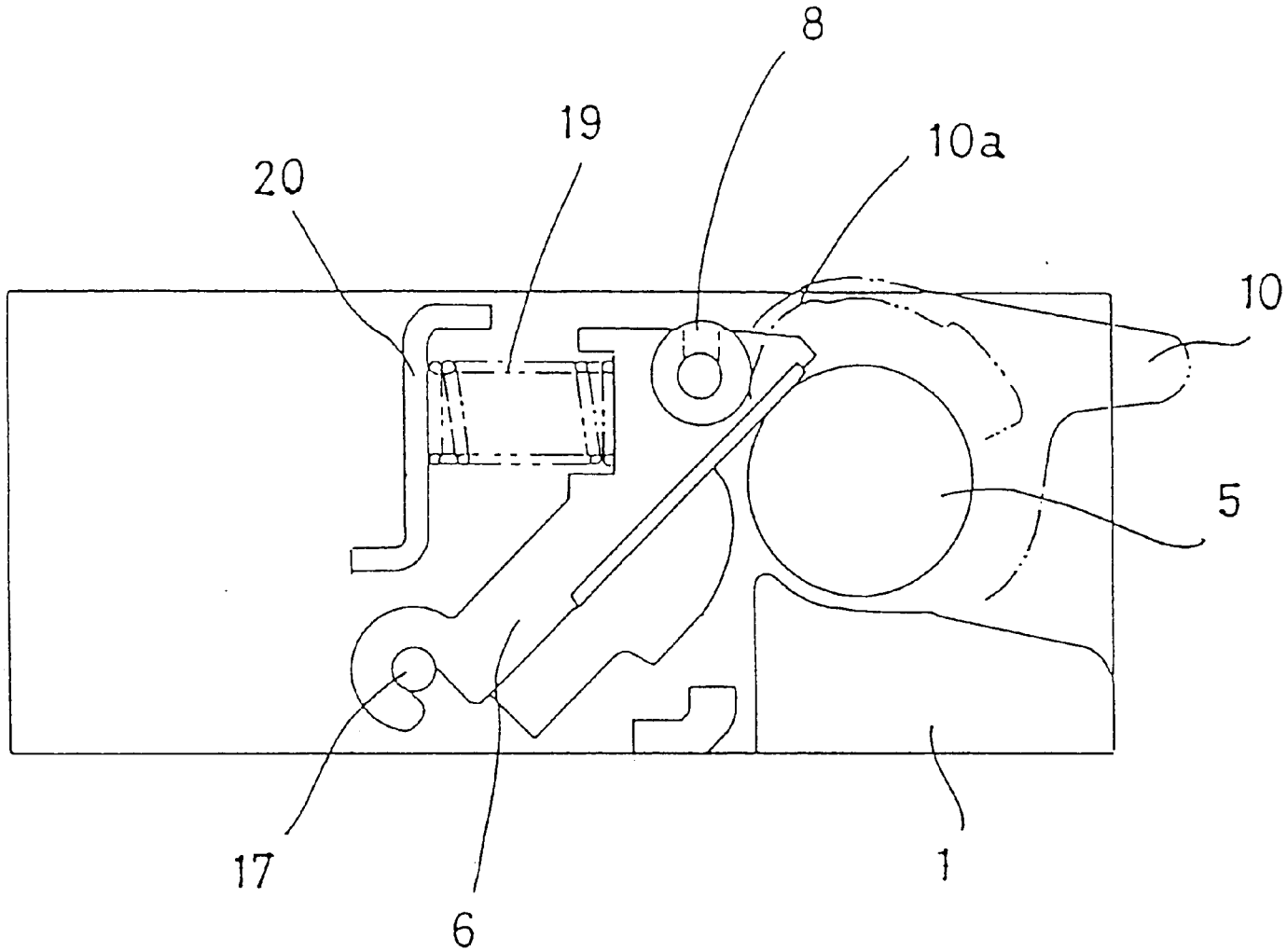
FIG. 6 is a section view of a prior art printer.

FIG. 2 shows a state in which the thermal head 6 is resiliently pressed to the platen 5 by the leaf spring 7 and FIG. 3 shows a state in which the resilience of the leaf spring 7 is released from the thermal head. Further, FIG. 4 shows a relationship of position of the head-up switch 18, the head-up lever 10 and the thermal head 6 in the state in which the resilience of the leaf spring 7 is applied to the thermal head 6. FIG. 5 shows a relationship of position and engagement of the head-up switch, the head-up lever and the thermal head in the head-up state in which the head-up lever 10 is turned from the state shown in FIG. 4.

In the normal printing states shown in FIGS. 2 and 4, the thermal head 6 is held in the state in which a printing section thereof is pressed to the platen 5 by the resilience of the leaf spring 7 which is pressed by the pressing plate 4 wholly in the longitudinal direction thereof. In this state, the head-up switch 18 is turned ON as it contacts with the cam 10*a* of the head-up lever 10 provided at one end of the pressing plate 4. That is, the ON state of the head-up switch 18 is held and thereby a printer control section not shown acknowledges that the thermal head 6 is pressed to the platen 5 and that the printer is enabled to print.

On the other hand, when it becomes necessary to release the pressing force of the thermal head 6 applied to the platen 5 in order to eliminate a failure such as a paper jam occurred during a printing operation for example, the head-up lever 10 provided at one end of the pressing plate 4 is turned to release the pressure of the pressing plate 4 applied to the leaf spring 7 as shown in FIG. 3 or FIG. 5. In this state, the leaf spring 7 is in a relaxed state in which it exerts no biasing force and the thermal head 6 will not receive a coercive resilient pressure of the leaf spring 7 and contacts with the platen 5 only by its own weight and the resilience of the FPC connected to one end of the thermal head. In the same time, the head-up switch will not contact with the cam of the head-up lever and the head-up switch is put in a state in which it is shut OFF. The printer control section (not shown) which detects that fact detects that the thermal head is in the head-up state at this initial point of time. Then, when the head-up lever is turned further, the cam 10*a* provided on the head-up lever engages with the head-up pin 8 provided at one end of the thermal head and while holding this engagement, the head-up lever turns the thermal head 6 coercively in the direction of releasing it from the platen 5. At this time, the leaf spring 7 is pushed up in linkage with the thermal head while being positioned by the pins 13 of the frame 1. Further, the pressing plate 4 turns integrally together with the head-up lever and during this series of actions, the thermal head is released from the resilient pressure applied by the leaf spring or the pressing plate.

Thus, because the thermal head is adapted so that it is pressed by the homogeneous resilience across the whole range in the longitudinal direction thereof by one leaf spring or the pressing plate and so that when the resilience of the leaf spring is released, no load is applied to the other components of the printer by the resilience of the leaf spring, the high precision printer may be realized with the simple structure. Further, the realization of the press-contact of the thermal head to the platen by means of the leaf spring allows the structure to be simplified as compared to the prior art thermal head press-contact structure. For example, it becomes possible to construct a printer having a different size in the width direction by the same components, design and specification just by changing the width of the thermal head in accordance with a width of a recording sheet. Therefore, it becomes unnecessary to design accommodating to the size of the printer due to the spring for pressing the thermal head.

It is also noted that a support frame 12 of the FPC connected to transmit driving signals for printing to the thermal head is formed at part of the frame to support the FPC by the printer frame and to take a countermeasure to static electricity of an IC for driving the head provided on part of the FPC.

As described above, according to the present invention, because the leaf spring and the pressing plate for wholly pressing the leaf spring are provided, the resilience may be applied to the thermal head with a homogeneous pressure. Further, because the head-up lever is provided at one end of the rotational shaft of the pressing plate to release the resilience of the leaf spring, to coercively cause the thermal head to head up and to turn ON/OFF the head-up switch by part of the head-up lever, a printer which has a very simple structure, whose assembling efficiency is improved and whose printing quality is stable may be realized.

We claim:

1. A line thermal printer comprising:

a frame;

a platen rotatable supported by the frame and having a rotation transmission mechanism at one end thereof;

a motor for driving the rotation transmission mechanism of the platen to rotate the platen;

a thermal head supported by the frame for pivotal movement into and out of pressure contact with the platen for recording printing data to a recording sheet disposed between the thermal head and the platen;

a pressing plate supported by the frame for pivotal movement and having a head-up lever fixed thereto for turning the pressing plate to release the thermal head from pressure contact with the platen;

a leaf spring disposed between the pressing plate and the thermal head for resiliently biasing the thermal head to the platen by a pressure of the pressing plate; and a head-up switch;

wherein when the head-up lever turns the pressing plate to release the thermal head from pressure contact with the platen, the pressure applied to the leaf spring by the pressing plate is released and the leaf spring is placed in a completely relaxed state in which it exerts no biasing force.

2. A line thermal printer according to claim 1; wherein the pressing plate has a rotational center shaft supported by the frame for pivotal movement and a press-contact portion connected eccentrically to the rotational center shaft and disposed parallel along a length of the leaf spring for applying a uniform pressure to the thermal head through the leaf spring.

3. A line thermal printer according to claim 1; wherein a portion of the head-up lever comprises a cam; and wherein when the head-up lever is turned to release the thermal head from pressure contact with the platen, the cam engages a portion of the thermal head to thereby release the thermal head from pressure contact with the platen.

4. A line thermal printer according to claim 1; wherein the head-up switch is disposed near the head-up lever; and wherein the cam of the head-up lever is movable between a position in contact with the head-up switch to indicate a head-down state, in which the thermal head is pressed into contact with the platen to enable recording of printing data on a recording sheet, and a position not in contact with the head-up switch to indicate a head-up state, in which the head-up lever is turned and the pressure contact between the thermal head and the platen is released.

5. A line thermal printer according to claim 1; wherein the leaf spring is positioned and supported by pins formed on the frame.

6. A line thermal printer according to claim 1; wherein the leaf spring resiliently presses the thermal head to the platen by its own resilience when it is pressed by the pressing plate.

7. A line thermal printer according to claim 6; wherein the leaf spring comprises a plurality of cutaway portions disposed in a longitudinal direction of the leaf spring for applying a homogeneous resilience to the thermal head.

8. The line thermal printer according to claim 1, characterized in that a frame for pressing a flexible printed board connected to said thermal head is formed on part of said frame.

9. A line thermal printer according to claim 3; wherein the pressing plate has a rotation shaft supported by the frame for pivotal movement, the head-up lever being integrally connected to an end of the rotation shaft.

10. A line thermal printer according to claim 3; wherein the portion of the thermal head engaged by the cam of the head-up lever comprises a pin integral with the thermal head.

11. A line thermal printer comprising: a frame; a platen supported by the frame for rotation; a thermal head supported by the frame for pivotal movement into and out of pressure contact with the platen; a leaf spring having a biased state in which the leaf spring resiliently biases the thermal head into pressure contact with the platen, and an unbiased, relaxed state in which the thermal head is released from pressure contact with the platen; a pressing plate pivotally supported relative to the frame for applying pressure to the leaf spring to place the leaf spring in the biased state; and a head-up lever for pivoting the pressing plate to release the pressure applied to the leaf spring to place the leaf spring in the unbiased, relaxed state whereby the thermal head is released from pressure contact with the platen.

12. A line thermal printer as claimed in claim 11; wherein the leaf spring is disposed between the pressing plate and the thermal head and is integrally connected to the frame.

13. A line thermal printer as claimed in claim 12; wherein the leaf spring comprises first portions for resiliently pressing the thermal head into pressure contact with the platen by pressure of the pressing plate, and a second portion for connecting the leaf spring integrally to the frame.

14. A line thermal printer as claimed in claim 13; wherein the second portion of the leaf spring comprises a plurality of apertures; and wherein the frame comprises a plurality of pins each extending through one of the apertures of the leaf spring for integrally connecting the leaf string to the frame.

15. A line thermal printer as claimed in claim 11; wherein the pressing plate is eccentrically connected to a rotation shaft supported by the frame for pivotal movement.

16. A line thermal printer as claimed in claim 15; wherein the pressing plate is eccentrically connected to the rotation shaft thereof and extends parallel along a length of the leaf spring for applying a uniform pressure to the leaf spring, whereby the leaf spring uniformly presses the thermal head into pressure contact with the platen.

17. A line thermal printer as claimed in claim 11; wherein the head-up lever comprises a cam portion for contacting the thermal head when the thermal head is released from pressure contact with the platen.

18. A line thermal printer as claimed in claim 17; further comprising a switch for outputting a signal indicative of a head-down state in which the thermal head is pressed into pressure contact with the platen, or a head-up state in which the thermal head is released from pressure contact with the platen; and wherein the cam portion of the head-up lever is movable between a position in contact with the switch, whereby the switch outputs a signal indicative of the head-down state, and a position not in contact with the switch, whereby the switch outputs a signal indicative of the head-up state.

19. A line thermal printer as claimed in claim 11; further comprising a switch for outputting a signal indicative of a head-down state in which the thermal head is pressed into pressure contact with the platen, or a head-up state in which the thermal head is released from pressure contact with the platen.

20. A line thermal printer as claimed in claim 19; wherein the head-up lever has a cam portion movable between a position in contact with the switch whereby the switch outputs a signal indicative of the head-down state, and a position not in contact with the switch whereby the switch outputs a signal indicative of the head-up state.

21. A line thermal printer as claimed in claim 11; wherein the pressing plate is eccentrically connected to a rotation shaft supported by the frame for pivotal movement and extends parallel along a length of the leaf spring for applying a uniform pressure to the leaf spring, whereby the leaf spring uniformly presses the thermal head into pressure contact with the platen.

22. A line thermal printer comprising: a frame; a platen supported by the frame for rotation; a thermal head supported by the frame for pivotal movement into and out of pressure contact with the platen for recording printing data to a recording medium disposed between the thermal head and the platen; a leaf spring for resiliently pressing the thermal head into pressure contact with the platen; a pressing plate having a rotation shaft supported by the frame for pivotal movement for applying pressure to the leaf spring to resiliently press the thermal head into pressure contact with the platen, the leaf spring being disposed between the pressing plate and the thermal head; and a head-up lever integrally connected to an end of the rotation shaft of the pressing plate for pivoting the pressing plate to release the pressure applied to the leaf spring to place the leaf spring in a relaxed state to thereby release the thermal head from pressure contact with the platen.

23. A line thermal printer as claimed in claim 22; further comprising a switch for outputting a signal indicative of a head-down state in which the thermal head is pressed into pressure contact with the platen, or a head-up state in which the thermal head is released from pressure contact with the platen.

24. A line thermal printer as claimed in claim 23; wherein the head-up lever has a cam portion movable between a position in contact with the switch whereby the switch outputs a signal indicative of the head-down state, and a position not in contact with the switch whereby the switch outputs a signal indicative of the head-up state.

25. A line thermal printer as claimed in claim 23; further comprising a rotation transmission mechanism for rotating the platen, and a motor for driving the rotation transmission mechanism.

26. A line thermal printer as claimed in claim 25; wherein the leaf spring has first portions for resiliently pressing the thermal head into pressure contact with the platen by pressure of the pressing plate, and a second portion for connecting the leaf spring integrally to the frame.

27. A line thermal printer as claimed in claim 26; wherein the second portion of the leaf spring has a plurality of apertures; and wherein the frame has a plurality of pins each extending through one of the apertures of the leaf spring for integrally connecting the leaf spring to the frame.

28. A line thermal printer as claimed in claim 22; wherein the leaf spring has a biased state for resiliently biasing the thermal head into pressure contact with the platen, and an unbiased, relaxed state in which the thermal head is released from pressure contact with the platen.

* * * * *